US005389277A

United States Patent [19]

Prieto

[11] Patent Number: 5,389,277

[45] Date of Patent: Feb. 14, 1995

[54] SECONDARY ALKYL SULFATE-CONTAINING POWDERED LAUNDRY DETERGENT COMPOSITIONS

[75] Inventor: Nelson E. Prieto, Richmond, Tex.

[73] Assignee: Shell Oil Company, Houston, Tex.

[21] Appl. No.: 129,898

[22] Filed: Sep. 30, 1993

[51] Int. Cl.[6] ..... C11D 7/18; C11D 7/38; C11D 3/395; C11D 1/12

[52] U.S. Cl. ..... 252/99; 252/95; 252/174.14; 252/174.19; 252/531; 252/550

[58] Field of Search ..... 252/99, 531, 550, 95, 252/174.14, 174.19

[56] References Cited

U.S. PATENT DOCUMENTS

| | | | |
|---|---|---|---|
| 3,838,072 | 9/1974 | Smith et al. | 252/540 |
| 4,052,342 | 10/1977 | Fernley et al. | 252/541 |
| 4,162,994 | 7/1979 | Kowalchuk | 252/532 |
| 4,235,752 | 11/1980 | Rossall et al. | 252/551 |
| 4,490,271 | 12/1984 | Spedini et al. | 252/174.23 |
| 4,604,224 | 8/1986 | Cheng | 252/91 |
| 4,664,950 | 5/1987 | Wixon | 427/214 |
| 4,666,740 | 5/1987 | Wixon | 427/214 |
| 4,692,275 | 9/1987 | Secemski | 252/534 |
| 4,783,281 | 11/1988 | Bishop et al. | 252/135 |
| 4,828,721 | 5/1989 | Bollier et al. | 252/8.7 |
| 4,923,636 | 5/1990 | Blackburn et al. | 252/550 |
| 4,929,379 | 5/1990 | Oldenburg et al. | 252/109 |
| 5,009,804 | 4/1991 | Clayton et al. | 252/90 |
| 5,034,158 | 7/1991 | Merrill et al. | 242/545 |
| 5,073,293 | 12/1991 | Deguchi et al. | 252/174.17 |
| 5,075,041 | 12/1991 | Lutz | 252/548 |
| 5,091,101 | 2/1992 | Hildreth | 252/89.1 |
| 5,236,613 | 8/1993 | Garner-Gray et al. | 252/94 |
| 5,238,594 | 8/1993 | Chapple | 252/95 |
| 5,259,981 | 11/1993 | Chapple | 252/95 |
| 5,259,982 | 11/1993 | Chapple | 252/95 |

FOREIGN PATENT DOCUMENTS

| | | |
|---|---|---|
| 884656 | 1/1958 | United Kingdom . |
| 1560073 | 1/1980 | United Kingdom . |

*Primary Examiner*—Richard L. Raymond
*Assistant Examiner*—Mary C. Cebulak
*Attorney, Agent, or Firm*—Pamela J. McCollough

[57] ABSTRACT

The present invention relates to a powdered detergent composition comprising from about 2 percent by weight to about 30 percent by weight, basis the total weight of the composition, of one or more secondary alkyl sulfate compounds and from about 30 percent by weight to about 85 percent by weight, basis the total weight of the composition, of one or more builders, from about 0.1 percent by weight to about 48 percent by weight, basis the total weight of the composition, of one or more fillers, and from about 0 percent by weight to about 12 percent by weight, basis the total weight of the composition, of one or more bleach compounds.

17 Claims, 1 Drawing Sheet

SECONDARY ALKYL SULFATE-CONTAINING POWDERED LAUNDRY DETERGENT COMPOSITIONS

FIELD OF THE INVENTION

The present invention relates to powdered detergent compositions containing one or more secondary alkyl sulfate compounds as anionic surfactant components.

BACKGROUND OF THE INVENTION

Linear alkylbenzene sulfonate (LAS) and primary alkyl sulfate (PAS) are widely used as anionic surfactants in commerce. They find special application for use in light and heavy duty liquid and powdered detergents. A potential disadvantage of LAS and PAS, however, is that under hard water conditions, i.e., calcium levels greater than about 150 parts per million, these anionic materials can interact with cationic water hardness ions, such as calcium, thereby becoming inactivated through precipitation. While this is a problem common to anionic surfactants, LAS and PAS are especially sensitive to water hardness ions.

Although not wishing to be bound by any theory, the literature indicates that the aforementioned interaction can best be understood by considering the micellar structure of these anionic surfactants such as , for example, LAS. Repulsive forces between negative charges in the sulfonate group lead to a higher critical micelle concentration (CMC) than, for example, with a nonionic surfactant. CMC is the surfactant concentration at which micellar formation begins. Stated otherwise, the negative charge of LAS retards micellar formation and shifts the equilibrium towards the monomer. A relatively high monomer concentration in solution results thereby; this is significant because precipitation between calcium ion and LAS occurs only with the monomer.

It has been found that powdered laundry detergent compositions containing secondary alkyl sulfate as an anionic surfactant component can be used in place of powdered laundry detergent compositions containing linear alkylbenzene sulfonates and/or primary alkyl sulfates with the advantages being increased tolerance for water hardness ions, good detergency properties, increased dissolution rates, higher active matter contents, lower water contents, and improved color of raw materials.

SUMMARY OF THE INVENTION

The present invention provides a powdered laundry detergent composition which comprises from about 2 percent by weight to about 30 percent by weight, basis the total weight of the composition, of one or more secondary alkyl sulfate compounds, from about 30 percent by weight to about 85 percent by weight, basis the total weight of the composition, of one or more builders, from about 0 percent by weight to about 12 percent by weight, basis the total weight of the composition, of one or more bleach compounds, and from about 0.1 percent by weight to about 48 percent by weight, basis the total weight of the composition, of one or more filler compounds.

DESCRIPTION OF THE PREFERRED EMBODIMENTS

Figure 1:
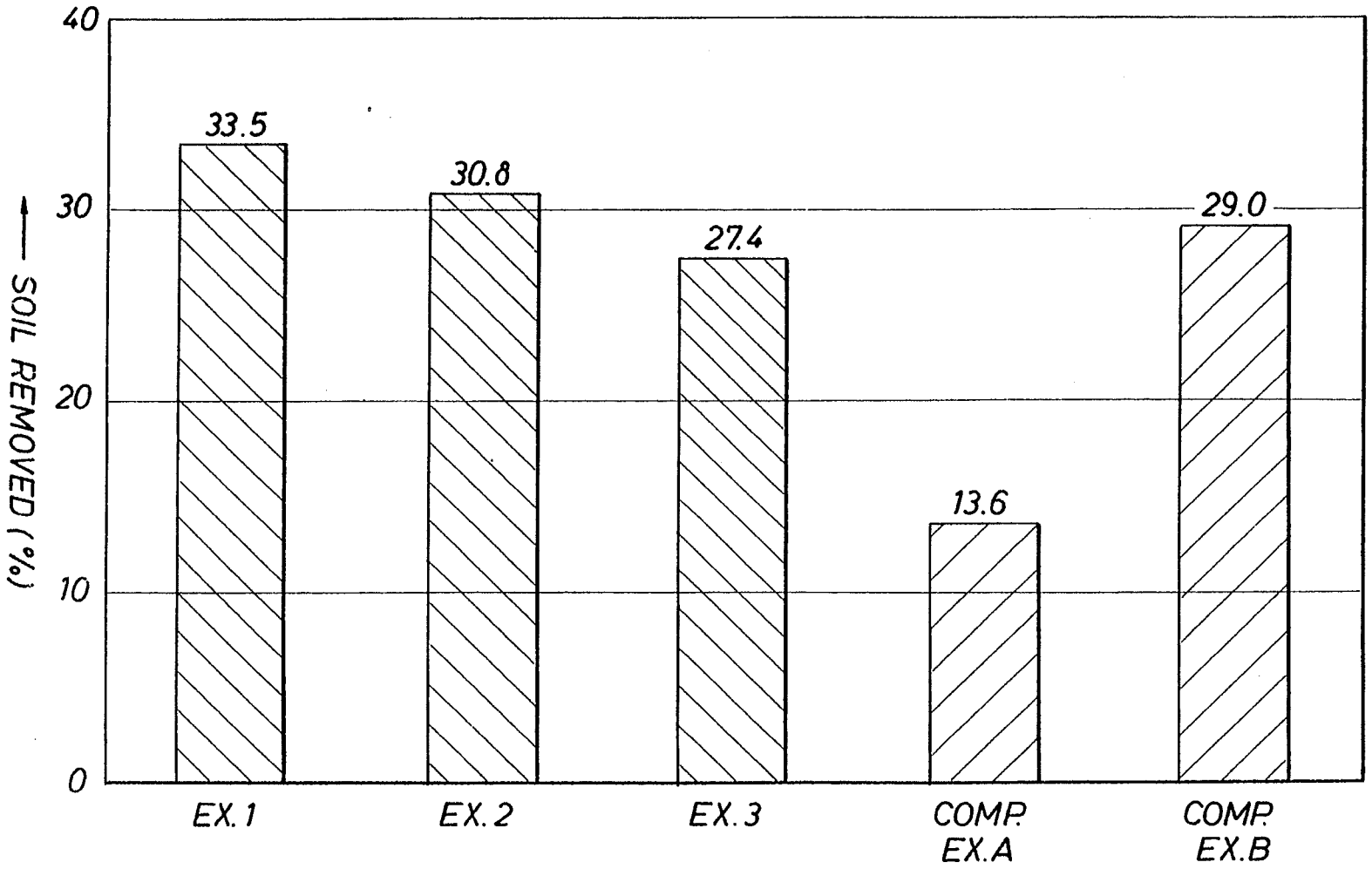
FIG. 1 represents the level of multisebum soil which can be removed by both secondary alkyl sulfate-containing powdered laundry detergent compositions and non-secondary alkyl sulfate-containing powdered laundry detergent composition from a polyester/cotton fabric at a temperature of 60° F. and a water hardness level of 300 parts per million.

The present invention therefore provides a powdered laundry detergent composition which comprises from about 2 percent by weight to about 30 percent by weight, preferably from about 5 percent by weight to about 20 percent by weight, basis the total weight of the composition, of one or more secondary alkyl sulfate compounds, from about 30 percent by weight to about 85 percent by weight, preferably from about 50 percent by weight to about 75 percent by weight, basis the total weight of the composition, of one or more builder compounds, from about 0 percent by weight to about 12 percent by weight, preferably from about 4 percent by weight to about 9 percent by weight, basis the total weight of the composition, of one or more bleach compounds, and from about 0.1 percent by weight to about 48 percent by weight, preferably from about 8 percent by weight to about 26 percent by weight, basis the total weight of the composition, of one or more filler compounds. anionic surfactant, the presence of these compounds aids in the removal of particulate and oily soils. The secondary alkyl sulfate component further aids in providing a detergent composition which is tolerant to hard water wash applications. In addition, the secondary alkyl sulfate component aids in facilitating the suspension of soil in the washwater and its effective separation from laundered fabrics. These several functions of the secondary alkyl sulfate compounds provide a very effective composition in terms of both its detergent performance and physical properties.

The secondary alkyl sulfate compounds suitable for use in the liquid laundry detergent composition of the present invention have the formula:

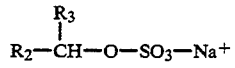

wherein $R_2$ represents an alkyl group having from about 3 to about 18 carbon atoms, and $R_3$ represents an alkyl group having from about 1 to about 6 carbon atoms. In a preferred embodiment, $R_2$ is an alkyl group having from about 10 to about 16 carbon atoms, and $R_3$ is an alkyl group having from about 1 to about 2 carbon atoms. It is preferred that $R_2$ and $R_3$ together are alkyl groups having a total of from about 11 to about 17 carbon atoms. Preferred secondary alkyl sulfate compounds include $C_{12}$ secondary alkyl sulfates (particularly those in which $R_2$ in the above formula represents an alkyl group having 10 carbon atoms and $R_3$ in the above formula represents an alkyl group having 1 carbon those in which $R_2$ in the above formula represents an alkyl group having 10 carbon atoms and $R_3$ in the above formula represents an alkyl group having 1 carbon atom, $C_{14}$ secondary alkyl sulfates, particularly those in which $R_2$ in the above formula represents an alkyl group having 12 carbon atoms and $R_3$ in the above formula represents an alkyl group having 1 carbon atom, $C_{16}$ secondary alkyl sulfates, particularly those in which $R_2$ in the above formula represents an alkyl group having 14 carbon atoms and $R_3$ in the above formula represents an alkyl group having 1 carbon atom, $C_{18}$ secondary alkyl sulfates, particularly those in which $R_2$ in the above formula represents an alkyl group having 16 carbon atoms and $R_3$ in the above formula represents an alkyl group having 1 carbon atom, and blends of these compounds. The secondary alkyl sulfate component of the laundry powder compositions of the present invention typically comprises a $C_{14}$ secondary alkyl sulfate compound, although blends of one or more $C_{14}$ secondary alkyl sulfate compounds and one or more $C_{18}$ secondary alkyl sulfate compounds, and blends of one or more $C_{14}$ secondary alkyl sulfate compounds, one or more $C_{16}$ secondary alkyl sulfate compounds, and one or more $C_{18}$ secondary alkyl sulfate compounds also provide suitable powdered laundry detergent compositions.

For enhanced biodegradability, it is preferred that the alkyl groups $R_2$ and $R_3$ of the secondary alkyl sulfate molecule all be of predominantly linear carbon chain structure. In this respect, it is particularly preferred that the surfactant molecules be essentially free of alkyl groups having multiple branches in the carbon chain.

The secondary alkyl sulfate compound(s) suitable for use in the present invention is a solid, free-flowing powdered material which has a water content of less than about three percent by weight and which is substantially free of diluents. These solid surface active compositions are generally prepared by a crystallization technique. Specifically, the solid secondary alkyl sulfate compositions are prepared by contacting a detergent range alkyl sulfuric acid-containing solution with a base in aqueous solution, removing substantially all of the water from the mixture, cooling in the presence of a nonionic organic liquid diluent to crystallize a solid secondary alkyl sulfate-containing surface active composition from the mixture, and recovering and drying the crystallized secondary alkyl sulfate product. The solid secondary alkyl sulfate product contains at least about 80 percent by weight to about 99 percent by weight of secondary alkyl sulfate. The product generally contains some residual level of sodium sulfate. The product typically contains less than about 12 percent by weight, preferably less than about 9 percent by weight, of sodium sulfate.

The powdered laundry detergent composition of the invention comprises from about 2 to about 30 percent by weight of the secondary alkyl sulfate component. Compositions containing from about 5 to about 20 percent by weight of the secondary alkyl sulfate component are preferred, while compositions containing from about 9 percent by weight and about 18 percent by weight of the secondary alkyl sulfate component are particularly more preferred.

The powdered laundry detergent may also contain one or more additional surfactant or cosurfactant compounds if desired. The additional surfactant or cosurfactant compound, if present, is selected from the group consisting of nonionic surfactants, anionic surfactants, cationic surfactants, zwitterionic surfactants and mixtures thereof. The additional or cosurfactant compounds, if present, function as cleaning agents in the powdered laundry detergent composition of the present invention. When the detergent composition contains an additional surfactant or cosurfactant compounds in addition to secondary alkyl sulfate, it is preferred that the additional surfactant be one or more nonionic surfactants.

The nonionic surfactant or cosurfactants generally useful as additional or cosurfactant compounds in the present invention are the ethylene oxide condensates, i.e., compounds produced by the condensation of ethylene oxide groups which are hydrophilic in nature with an organic hydrophobic compound which can be aliphatic or alkyl aromatic in nature, and the sugar-derived glycols, i.e., alkylpolyglycosides.

Particularly suitable nonionic surfactant component are made up of one or more ethylene oxide adducts, i.e. ethoxylates, of alcohols or alkyl-substituted phenols, and can be represented by the formula $R—O—(CH_2CH_2O)_n—H$, wherein the RO group corresponds to the starting alcohol or alkyl-substituted phenol (less its active hydrogen atom). In general, the suitable alcohol ethoxylates are derived from alcohols in the carbon range of from about 8 to about 18, while the suitable alkyl phenol ethoxylates are derived from alkyl phenols having alkyl substituents in the carbon range of from about 8 to about 12. Both the alcohol ethoxylates and the alkyl phenol ethoxylates are nonionic surfactants well known as components of conventional laundry detergent products.

With regard to the use of alcohol ethoxylate surfactants, the individual compounds are preferably characterized by an alkyl R group in the carbon number range of from about 11 to about 15. Both primary and secondary alcohol ethoxylates (having primary or secondary alkyl R groups, respectively) are suitable in the invention. The R group is suitably linear or branched.

The alkyl-substituted phenol ethoxylate compounds preferably have an alkyl substituent with between about 8 and about 11 carbon atoms. The alkyl substituent may either be branched or linear.

Suitable nonionic ethoxylate surfactants typically contain an average number of ethylene oxide units (i.e., an average value of n in the above formula) which is in the range of from about 3 to about 14 per molecule. Preferably, the ethoxylate surfactants contain an average number of ethylene oxide units which is in the range of from about 5 to about 9 per molecule.

The sugar-derived glycols or alkyl glycosides which are useful as nonionic surfactants preferably have from about 6 to about 30 carbon atoms. Particularly suitable sugar-derived glycols are the alkylpolyglycosides.

Suitable anionic surfactants for use as additional or cosurfactant compounds in the powdered laundry detergent compositions of the present invention include the water-soluble salts, particularly the alkali metal, ammonium, alkylammonium (e.g., monoethanolammonium, diethanolammonium, or triethanolammonium) salts of organic sulfuric acid reaction products having in their molecular structure an alkyl group containing from about 10 to about 20 carbon atoms and a sulfonic or sulfuric acid ester group. As used herein, the term "alkyl" also includes the alkyl portion of aryl groups. Examples of anionic synthetic surfactants include primary alkyl sulfates, especially those obtained by sulfating the higher alcohols ($C_8$ to $C_{18}$ carbon atoms), and alkylbenzene sulfonates in which the alkyl group contains from about 9 to about 15 carbon atoms in a straight chain or branched chain configuration.

Other suitable anionic surfactants which can be used as additional or cosurfactant compounds in the powdered laundry detergent compositions of the present invention include the water-soluble salts of: paraffin sulfonates containing from about 8 to about 24 carbon atoms; olefin sulfonates containing from about 8 to about 24 , preferably from about 12 to about 16 carbon atoms, particularly alpha olefin sulfonates; alkenyl or alkyl carboxysulfonates containing from about 8 to about 30 carbon atoms; alkyl ethoxycarboxylates containing from about 8 to about 24 carbon atoms and having from about 1 to about 10 units of ethylene oxide per molecule; alkyl glyceryl ether sulfonates derived from ethers of $C_8$–$C_{18}$ alcohols; alkyl phenol ethoxysulfates containing from about 1 to about 10 units of ethylene oxide per molecule and from about 8 to about 12 carbon atoms in the alkyl group; and ethoxysulfates, i.e., alkyl ethylene oxide ether sulfates, containing from about 1 to about 10 units of ethylene oxide per molecule and from about 10 to about 15 carbon atoms in the alkyl group. Especially suitable are water-soluble salts of alcohol ethoxysulfates containing from about 1 to about 6 units of ethylene oxide per molecule and from about 8 to about 18 carbon atoms in the alkyl group.

Also useful as anionic surfactants are the water-soluble salts of esters of alpha-sulfonated fatty acids containing from about 6 to about 20 carbon atoms in the fatty acid group and from about 1 to about 10 carbon atoms in the ester group; water-soluble salts of 2-acyloxyalkane-a-sulfonic acids containing from about 2 to about 9 carbon atoms in the acyl group and from about 9 to about 23 carbon atoms in the alkane moiety; and beta-alkoxy alkane sulfonates containing from about 1 to about 3 carbon atoms in the alkyl group and from about 8 to about 20 carbon atoms in the alkane moiety.

Suitable zwitterionic surfactants for use as additional surfactant or cosurfactant compounds in the present composition include derivatives of aliphatic quaternary ammonium, phosphonium, and sulfonium compounds in which the aliphatic moiety can be straight chain or branched chain and wherein one of the aliphatic substituents contains at least one anionic water-solubilizing group. Examples of suitable zwitterionic surfactants include 3-(N, N-dimethyl-N-hexadecylammonio)-propane-1-sulfonate and the ammonium sulfonates and sulfates disclosed in U.S. Pat. Nos. 3,925,262, issued Dec. 9, 1975, and 3,929,678, issued Dec. 30, 1975, the teachings of which are incorporated herein by reference.

Suitable cationic surfactants for use as additional or cosurfactant compounds in the present powdered detergent composition include octadecyl trimethylammonium chloride, cetyl trimethylammonium methyl sulfate, polymeric cationics derived from monomers such as N,N, N-trimethyl-N-methylacryloxy (2-hydroxypropyl) ammonium chloride and cationic monomers such as those described in U.S. Pat. Nos. 4,212,820, issued on Jul. 15, 1980, 4,098,987, issued on Jul. 4, 1978, 4,171,418, issued on Oct. 16, 1979, and 4,426,489, issued Jan. 7, 1984, the relevant teachings of which are incorporated herein by reference. In addition to quaternary ammonium cationic moieties, the compounds with phosphonium, sulfonium, pyridium and isothiouronium moieties and the like are also among the well known cationic surfactants.

When an additional surfactant or cosurfactant compound is utilized in the powdered detergent composition, it is typically present in an amount of from about 2 percent by weight to about 28 percent by weight, and preferably in the range of from about 2 percent by weight to about 20 percent by weight, basis the total weight of the laundry powder composition.

The powdered laundry detergent composition of the present invention also contains one or more builder compounds. Builders are known to be added to powdered detergent compositions to enhance cleaning performance by softening water and providing alkalinity and buffering capacity to the wash. The builder compounds can either be of the organic or inorganic type. The builder compound is preferably one or more materials selected from the group consisting of hydratable alkali metal phosphates, alkali metal carbonates and bicarbonates (mixed or separate, anhydrous or partially hydrated), zeolites (either crystalline or amorphous, and either natural or synthetic), ethylenediamine tetraacetate, nitrilotriacetate, and mixtures thereof. Carbonate and phosphate builders are particularly preferred. Examples of water-soluble inorganic builders which can be used, alone or in admixture with themselves and organic alkaline builder salts, are alkali metal carbonates, phosphates, polyphosphates, and silicates. Specific examples of such salts are sodium tripolyphosphate, sodium carbonate, potassium carbonate, trisodium phosphate, tetrasodium pyrophosphate, tetrapotassium pyrophosphate, potassium tripolyphosphate, and sodium hexametaphosphate. Examples of organic builder salts which can be used alone, or in admixture with each other or with the preceding inorganic alkaline builder salts are alkali metal polycarboxylates, e.g., water-soluble citrates such as sodium and potassium citrate, sodium and potassium tartrate, the sodium and potassium salts of tartaric acid monosuccinate, the sodium and potassium salts of tartaric acid disuccinate, sodium and potassium ethylenediaminetetraacetate, sodium and potassium N-(2-hydroxyethyl)-ethylene diamine triacetates, sodium and potassium nitrilo triacetates and sodium and potassium N-(2-hydroxyethyl)-nitrilo diacetates. Other organic detergency builders such as water-soluble phosphonates, gluconates and polymers such as, for example, polyacrylates, can find use in the compositions of the invention. The builder is present in the powdered detergent composition in an amount between about 30 percent by weight and about 85 percent by weight, preferably in an amount between about 50 percent by weight and about 75 percent by weight, and most preferably between about 51 percent by weight and about 67 percent by weight.

The powdered laundry detergent composition may also, if desired, contain a silicate anticorrosion agent, in an amount between about 2 percent by weight and about 10 percent by weight Alkali, alkaline earth and ammonium silicate salts are conventionally applied for this service and are very suitable for use in this invention. Sodium silicate is preferred. When the powdered laundry detergent contains a silicate component, such component is typically present in the composition in an amount in the range of from about 1 percent by weight to about 23 percent by weight, and preferably in an amount in the range of from about 1 percent by weight to about 7 percent by weight.

The balance of the powdered laundry detergent composition consists essentially of one or more filler compounds. These compound(s) are typically inert solid powders. The filler compound is selected from the group consisting of sodium chloride, sodium sulfate and mixtures thereof. In a preferred embodiment, the filler compound is sodium sulfate.

In a preferred embodiment, the powdered laundry detergent composition of the present invention also contains one or more bleach compounds. Suitable bleach compounds include perborate, percarbonate, etc., and the like, and mixtures thereof. The bleach compound may also be used in combination with an activator such as, for example, tetra-acetyl-ethylenediamine (TAED), sodium nonanoyloxybenzene sulfonate (SNOBS), diperoxydodecanedioc acid (DPDDA) and the like, and mixtures thereof. When the composition contains one or more bleach compounds, the bleach compound generally comprises from about 0 percent by weight to about 12 percent by weight, preferably from about 4 percent by weight to about 9 percent by weight, basis the total weight of the composition.

In addition to its three principal components, secondary alkyl sulfate, builder, and filler, the powdered laundry detergent composition may suitably contain minor amounts of other components known in the art for use in laundry powders. Non-limiting examples of such component include dyes, fragrances, brighteners, complexing agents, process aids, enzymes, and the like. The amount of each of these components present in the powdered detergent composition will typically be less than about 7 percent by weight, and preferably less than about 3 percent by weight, basis the total weight of the composition.

The principal components of the powdered detergent composition are suitably blended into the finished composition by conventional methods for the preparation of powdered detergent compositions, for instance, by the spray drying of an aqueous mixture of the builder and the filler to form base beads, followed by blending of the beads with the surfactants and other components; by dry blending or agglomeration techniques; or by any combination of these methods.

In a preferred embodiment, the powdered laundry detergent composition contains from about 5 percent by weight to about 20 percent by weight, basis the total weight of the composition, of a secondary alkyl sulfate compound having a carbon number in the range of from about 12 to about 16, from about 50 percent by weight to about 75 percent by weight, basis the total weight of the composition, of one or more builder compounds, from about 8 percent by weight to about 28 percent by weight, basis the total weight of the composition, of one or more filler compounds, and from about 4 percent by weight to about 9 percent by weight, basis the total weight of the composition, of one or more bleach compounds.

The ranges and limitations provided in the instant specification and claims are those which are believed to particularly point out and distinctly claim the present invention. It is, however, understood that other ranges and limitations which perform substantially the same function in substantially the same manner to obtain the same or substantially the same result are intended to be within the scope of the present invention as defined by the specification and claims.

The invention is further described with reference to the following examples, which are intended to illustrate certain aspects of the invention, without limiting its broader scope.

ILLUSTRATIVE EMBODIMENTS

EXAMPLE 1

4.4 Grams of $C_{12}$–$C_{13}$ alcohol ethoxylate having an average of 6.5 ethylene oxide units per molecule were warmed to 120° F. and added at a rate of 2.2 cc/min. to 62.5 grams of sodium carbonate (light density) and blended at 100 revolutions per minute (rpm) using a Brabender dry mixer and allowed to mix well. 62.5 Grams of zeolite A (sodium form) were then added to the alcohol ethoxylate/sodium carbonate mixture, followed by the addition of 17.8 grams of $C_{14}$ secondary alkyl sulfate (sodium salt, 99% active). The resulting material was a flowable powder. The properties of the composition prepared are presented in Table I and FIG. 1.

EXAMPLE 2

4.4 Grams of $C_{12}$–$C_{13}$ alcohol ethoxylate having an average of 6.5 ethylene oxide units per molecule were warmed to 120° F. and added at a rate of 2.2 cc/min. to 62.5 grams of sodium carbonate (light density) and blended at 100 revolutions per minute (rpm) using a Brabender dry mixer and allowed to mix well. 62.5 Grams of zeolite A (sodium form) were then added to the alcohol ethoxylate/sodium carbonate mixture, followed by the addition of 8.9 grams of $C_{14}$ secondary alkyl sulfate (sodium salt, 99% active) and 8.9 grams of $C_{16}$ secondary alkyl sulfate (sodium salt, 99% active). The resulting material was a flowable powder. The properties of the composition prepared are presented in Table I and FIG. 1.

EXAMPLE 3

4.4 Grams of $C_{12}$–$C_{13}$ alcohol ethoxylate having an average of 6.5 ethylene oxide units per molecule were warmed to 120° F. and added at a rate of 2.2 cc/min. to 62.5 grams of sodium carbonate (light density) and blended at 100 revolutions per minute (rpm) using a Brabender dry mixer and allowed to mix well. 62.5 Grams of zeolite A (sodium form) were then added to the alcohol ethoxylate/sodium carbonate mixture, followed by the addition of 17.8 grams of $C_{16}$ secondary alkyl sulfate (sodium salt, 99% active). The resulting material was a flowable powder. The properties of the composition prepared are presented in Table I and FIG. 1.

COMPARATIVE EXAMPLE A

Comparative Example A was carried out in a manner similar to Example 1, except that 29.7 grams of $C_{13}$ linear alkylbenzene sulfonate (LAS) (sodium salt, 60% active) were used in place of the secondary alkyl sulfate. The properties of the composition prepared are presented in Table I and FIG. 1.

COMPARATIVE EXAMPLE B

Comparative Example B was carried out in a manner similar to Example 1, except that 71.2 grams of $C_{14}$–$C_{15}$ primary alcohol sulfate (PAS) (sodium salt, 25% active) were used in place of the secondary alkyl sulfate. The properties of the composition prepared are presented in Table I and FIG. 1.

DISCUSSION OF THE RESULTS AND DETAILED DESCRIPTION OF THE DRAWING

As can be seen in Table I and FIG. 1, the level of soil removal obtained with secondary alkyl sulfate-containing powdered laundry detergents (Examples 1–3) is much higher than that obtained with powdered laundry detergents containing LAS (Comparative Example A). It can also be seen in Table I and FIG. 1 that the level of soil removal obtained with powdered laundry detergents containing $C_{14}$ SAS (Example 1) is higher than that obtained with powdered laundry detergents containing PAS (Comparative Example B), and that the level of soil removed with powdered laundry detergents containing mixtures of $C_{14}$ SAS and $C_{16}$ SAS (Example 2) and $C_{16}$ SAS (Example 3) is approximately the same as that obtained with powdered laundry detergents containing PAS (Comparative Example B).

TABLE I

SECONDARY ALKYLSULFATES (SAS) IN HEAVY DUTY POWDERS (HDP's)

| Component, % wt | Ex. 1 | Ex. 2 | Ex. 3 | Comp. Ex. A | Comp. Ex. B |
|---|---|---|---|---|---|
| Basis 100% active unless otherwise indicated | | | | | |
| $C_{14}$SAS | 12 | 6 | — | — | — |
| $C_{16}$SAS | — | 6 | 12 | — | — |
| $C_{13}$LAS (60%) | — | — | — | 12 | — |
| $C_{14-15}$PAS (17.3%) | — | — | — | — | 12 |
| $C_{12-13}EO_{6.5}$ | 3 | 3 | 3 | 3 | 3 |
| Sodium Carbonate | 42.5 | 42.5 | 42.5 | 42.5 | 42.5 |
| Sodium Zeolite A | 42.5 | 42.5 | 42.5 | 42.5 | 42.5 |
| Detergency[a)] | 33.5 | 30.8 | 27.4 | 13.6 | 29.0 |

[a)]Temperature 60° F., 300 ppm water hardness. Radiolabeled sebum soil removal from permanent press (65/35) polyester/cotton was determined as described in "Detergency. Theory and Technology", G. W. Cutler and E. Kissa, eds., Surfactant Science Series, Vol. 20, p. 125 (1987) and N. Prieto, J. Am. Oil Chem. Soc. 66 10 (1989). All examples and comparative examples were tested at a dose of 1.4 grams/liter. Results are expressed as percent soil removal.

What is claimed is:

1. A powdered detergent composition comprising from about 2 percent by weight to about 30 percent by weight, basis the total weight of the composition, of one or more secondary alkyl sulfate compounds, from about 30 percent by weight to about 85 percent by weight, basis the total weight of the composition, of one or more builders, from about 0.1 percent by weight to about 48 percent by weight, basis the total weight of the composition, of one or more fillers, and from about 0 percent by weight to about 12 percent by weight, basis the total weight of the composition, of one or more bleach compounds.

2. The composition of claim 1 wherein said one or more secondary alkyl sulfate compounds has a formula:

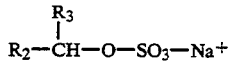

wherein $R_2$ represents an alkyl group having from about 3 to about 18 carbon atoms and $R_3$ represents an alkyl group having from about 1 to about 6 carbon atoms.

3. The composition of claim 2 wherein said one or more secondary alkyl sulfate compounds is a $C_{14}$ secondary alkyl sulfate wherein $R_2$ represents an alkyl group having 12 carbon atoms and $R_3$ represents an alkyl group having 1 carbon atom.

4. The composition of claim 2 wherein said one or more secondary alkyl sulfate compounds is a $C_{16}$ secondary alkyl sulfate wherein $R_2$ represents an alkyl group having 14 carbon atoms and $R_3$ represents an alkyl group having 1 carbon atom.

5. The composition of claim 2 wherein said one or more secondary alkyl sulfate compounds is a mixture of a $C_{14}$ secondary alkyl sulfate wherein $R_2$ represents an alkyl group having 12 carbon atoms and $R_3$ represents an alkyl group having 1 carbon atom and a $C_{16}$ secondary alkyl sulfate wherein $R_2$ represents an alkyl group having 14 carbon atoms and $R_3$ represents an alkyl group having 1 carbon atom.

6. The composition of claim 1 wherein said one or more secondary alkyl sulfate compounds is added to the composition in the form of a free flowing powder.

7. The composition of claim 1 wherein said secondary alkyl sulfate compound(s) is present in an amount of from about 5 percent by weight to about 20 percent by weight, basis the total weight of the composition.

8. The composition of claim 1 wherein said one or more builders is selected from the group consisting of alkali metal carbonates, alkali metal phosphates, alkali metal polyphosphates, alkali metal silicates, alkali metal bicarbonates, alkali metal polycarboxylates, zeolites and mixtures thereof.

9. The composition of claim 8 wherein said one or more builders is selected from alkali metal polycarboxylates, zeolites, alkali metal carbonates, alkali metal silicates and mixtures thereof.

10. The composition of claim 1 wherein said builder(s) is present in an amount of from about 50 percent by weight to about 75 percent by weight, basis the total weight of the composition.

11. The composition of claim 1 wherein said composition comprises from about 8 percent by weight to about 26 percent by weight, basis the total weight of the composition, of one or more fillers.

12. The composition of claim 11 wherein said one or more fillers is selected from the group consisting of sodium chloride, sodium sulfate, and mixtures thereof.

13. The composition of claim 1 wherein said composition comprises from about 4 percent by weight to about 9 percent by weight, basis the total weight of the composition, of one or more bleach compounds.

14. The composition of claim 13 wherein said one or more bleach compounds is selected from the group consisting of perborate, percarbonate, and mixtures thereof.

15. A powdered detergent composition comprising from about 5 percent by weight to about 20 percent by weight, basis the total weight of the composition, of one or more secondary alkyl sulfate compounds, from about 50 percent by weight to about 75 percent by weight, basis the total weight of the composition, of one or more builders, from about 8 percent by weight to about 26 percent by weight, basis the total weight of the composition, of one or more fillers, and from about 4 percent by weight to about 9 percent by weight, basis the total weight of the composition, of one or more bleach compounds.

16. The composition of claim 1 wherein said composition additionally comprises one or more additional surfactant compounds selected from the group consisting of nonionic surfactants, anionic surfactants, cationic surfactants, zwitterionic surfactants and mixtures thereof.

17. The composition of claim 15 wherein said composition additionally comprises one or more additional surfactant compounds selected from the group consisting of nonionic surfactants, anionic surfactants, cationic surfactants, zwitterionic surfactants and mixtures thereof.

* * * * *